US010834987B1

(12) United States Patent
Bottlang et al.

(10) Patent No.: US 10,834,987 B1
(45) Date of Patent: Nov. 17, 2020

(54) PROTECTIVE LINER FOR HELMETS AND OTHER ARTICLES

(71) Applicant: Apex Biomedical Company LLC, Portland, OR (US)

(72) Inventors: Michael Bottlang, Portland, OR (US); Steven Madey, West Linn, OR (US); Stanley Tsai, Portland, OR (US); Jeffrey Bennett, Portland, OR (US); Devin Knowles, Portland, OR (US)

(73) Assignee: Apex Biomedical Company, LLC, Portland, OR (US)

( * ) Notice: Subject to any disclaimer, the term of this patent is extended or adjusted under 35 U.S.C. 154(b) by 391 days.

(21) Appl. No.: 15/449,898

(22) Filed: Mar. 3, 2017

Related U.S. Application Data

(63) Continuation-in-part of application No. 13/803,962, filed on Mar. 14, 2013, now abandoned.

(60) Provisional application No. 62/303,884, filed on Mar. 4, 2016, provisional application No. 61/670,258, filed on Jul. 11, 2012.

(51) Int. Cl.
*A42B 3/06* (2006.01)
*A42B 3/12* (2006.01)
*A63B 71/10* (2006.01)

(52) U.S. Cl.
CPC ..... *A42B 3/064* (2013.01); *A42B 3/125* (2013.01); *A63B 71/10* (2013.01)

(58) Field of Classification Search
CPC ..... A42B 3/125; A42B 3/064; A42B 3/06; A42B 3/063; A42B 3/10; A42B 3/12; A42B 3/128
See application file for complete search history.

(56) References Cited

U.S. PATENT DOCUMENTS 3,577,305 A * 5/1971 Hines ..... A41D 13/0155 428/72
3,877,076 A * 4/1975 Summers ..... A42B 3/065 2/414
3,999,220 A 12/1976 Keltner
4,213,202 A * 7/1980 Larry ..... A41D 31/285 2/456
4,227,593 A 10/1980 Bricmont et al.
4,526,421 A 7/1985 Brennan et al.
4,710,984 A 12/1987 Asper
5,025,504 A 6/1991 Benston et al.
5,561,866 A 10/1996 Ross
5,700,545 A 12/1997 Audi et al.
(Continued)

FOREIGN PATENT DOCUMENTS

CN 202019831 11/2011
DE 8409316 7/1984
(Continued)

*Primary Examiner* — Sally Haden
(74) *Attorney, Agent, or Firm* — Schwabe, Williamson & Wyatt, P.C.

(57) ABSTRACT

Embodiments herein employ a novel strategy based on a floating cellular liner that acts as a torsional suspension system to dampen rotational acceleration, such as head acceleration in a helmet, in response to an oblique impact. Specifically, the torsional suspension consists of an anisotropic cellular liner that is at least partially recessed inside a more rigid adjacent shell, relative to which the cellular liner can simultaneously undergo translation and in-plane compression.

9 Claims, 8 Drawing Sheets

(56) References Cited

U.S. PATENT DOCUMENTS 6,065,158 A 5/2000 Rush, III
6,332,226 B1 12/2001 Rush, III
6,387,200 B1 5/2002 Ashmead et al.
6,658,671 B1 * 12/2003 Von Holst ..... A42B 3/064 2/412
6,996,856 B2 * 2/2006 Puchalski ..... A42B 3/064 2/411
7,076,811 B2 * 7/2006 Puchalski ..... A42B 3/06 2/411
7,774,866 B2 * 8/2010 Ferrara ..... A42B 3/121 2/455
7,802,320 B2 * 9/2010 Morgan ..... A42B 3/128 2/411
7,930,771 B2 * 4/2011 Depreitere ..... A42B 3/064 2/411
8,347,421 B2 * 1/2013 Krueger ..... A41D 13/0151 2/459
8,756,719 B2 * 6/2014 Veazie ..... A42B 3/121 2/411
9,032,558 B2 * 5/2015 Leon ..... A42B 3/12 2/411
9,060,561 B2 * 6/2015 Knight ..... A42B 3/064
9,408,423 B2 * 8/2016 Guerra ..... A42B 3/064
2003/0140400 A1 * 7/2003 Ho ..... A42B 3/063 2/411
2004/0025229 A1 2/2004 Takahashi et al.
2004/0117896 A1 * 6/2004 Madey ..... A42B 3/064 2/411
2004/0223876 A1 11/2004 Kirollos et al.
2004/0250340 A1 * 12/2004 Piper ..... A42B 3/064 2/411
2005/0241048 A1 * 11/2005 Cattaneo ..... A42B 3/125 2/412
2005/0246824 A1 * 11/2005 Berger ..... A42B 3/124 2/412
2006/0059605 A1 3/2006 Ferrara
2006/0059606 A1 * 3/2006 Ferrara ..... A01N 25/18 2/412
2006/0148919 A1 * 7/2006 Maurer ..... B60R 21/04 521/137
2007/0000032 A1 * 1/2007 Morgan ..... A42B 3/124 2/412
2007/0068755 A1 * 3/2007 Hawkins ..... A41D 13/0518 188/371
2008/0066217 A1 * 3/2008 Depreitere ..... A42B 3/064 2/412
2009/0266663 A1 * 10/2009 Lin ..... A42B 3/063 188/372
2009/0320185 A1 * 12/2009 Hassler ..... A42B 3/125 2/414
2010/0000009 A1 * 1/2010 Morgan ..... A42B 3/124 2/414
2010/0299812 A1 * 12/2010 Maddux ..... A41D 13/0156 2/414
2011/0107503 A1 * 5/2011 Morgan ..... A42B 3/124 2/456
2011/0117310 A1 * 5/2011 Anderson ..... A41D 13/015 428/80
2011/0171420 A1 * 7/2011 Yang ..... A41D 13/0156 428/116
2012/0198604 A1 * 8/2012 Weber ..... A42B 3/125 2/414
2013/0019384 A1 * 1/2013 Knight ..... A42B 3/064 2/411
2013/0019385 A1 * 1/2013 Knight ..... A42B 3/064 2/411
2013/0042397 A1 * 2/2013 Halldin ..... A42B 3/064 2/411
2013/0061371 A1 * 3/2013 Phipps ..... A42B 3/064 2/411
2013/0122256 A1 * 5/2013 Kleiven ..... A42B 3/064 428/158
2013/0185837 A1 * 7/2013 Phipps ..... A42B 3/12 2/2.5
2013/0333100 A1 * 12/2013 Erb ..... A42B 3/124 2/425
2014/0013491 A1 * 1/2014 Hoshizaki ..... A42B 3/12 2/411
2014/0013492 A1 1/2014 Bottlang et al.
2014/0045962 A1 2/2014 Schofalvi et al.
2014/0130239 A1 * 5/2014 Preston-Powers ..... A42B 3/285 2/411
2014/0208486 A1 * 7/2014 Krueger ..... A42B 3/064 2/414
2015/0047110 A1 2/2015 Chilson
2015/0223547 A1 * 8/2015 Wibby ..... A42B 3/125 2/414
2015/0264991 A1 * 9/2015 Frey ..... A42B 3/064 2/411
2015/0313305 A1 * 11/2015 Daetwyler ..... A42B 3/285 2/414
2016/0021965 A1 * 1/2016 Mayerovitch ..... A42B 3/12 2/414
2016/0073723 A1 * 3/2016 Halldin ..... A42B 3/06 2/411

FOREIGN PATENT DOCUMENTS

EP 2389822 11/2011
WO 2001-45526 6/2001
WO 200145526 6/2001
WO 2007-042930 4/2007
WO 2011-139224 11/2011
WO 2007042930 11/2011
WO 2011-148146 12/2011
WO 2011139224 12/2011
WO WO 2012-020066 A1 2/2012
WO 2012-109381 8/2012
WO 2012109381 8/2012

* cited by examiner

PROTECTIVE LINER FOR HELMETS AND OTHER ARTICLES

CROSS REFERENCE TO RELATED APPLICATIONS

The present application claims priority to U.S. Provisional Patent Application No. 62/303,884, filed Mar. 4, 2016, entitled "Protective Liner for Helmets and Other Articles," the entire disclosure of which is hereby incorporated by reference in its entirety. The present application is also a Continuation-in-Part of and claims priority to U.S. patent application Ser. No. 13/803,962, filed Mar. 14, 2013, entitled "Protective Helmet for Mitigation of Linear and Rotational Acceleration," which claims priority to U.S. Provisional Patent Application No. 61/670,258, filed Jul. 11, 2012, entitled "Protective Helmet for Mitigation of Linear and Rotational Acceleration," the entire disclosures of which are hereby incorporated by reference in their entirety.

TECHNICAL FIELD

Embodiments herein relate to a protective liner, such as for use in helmets and other articles.

BACKGROUND

Contemporary helmets are primarily designed to protect a skull from fracture during impact. The brain is however most sensitive to rapid head rotation, or rotational acceleration, which is readily caused by an oblique impact to the head.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1A:
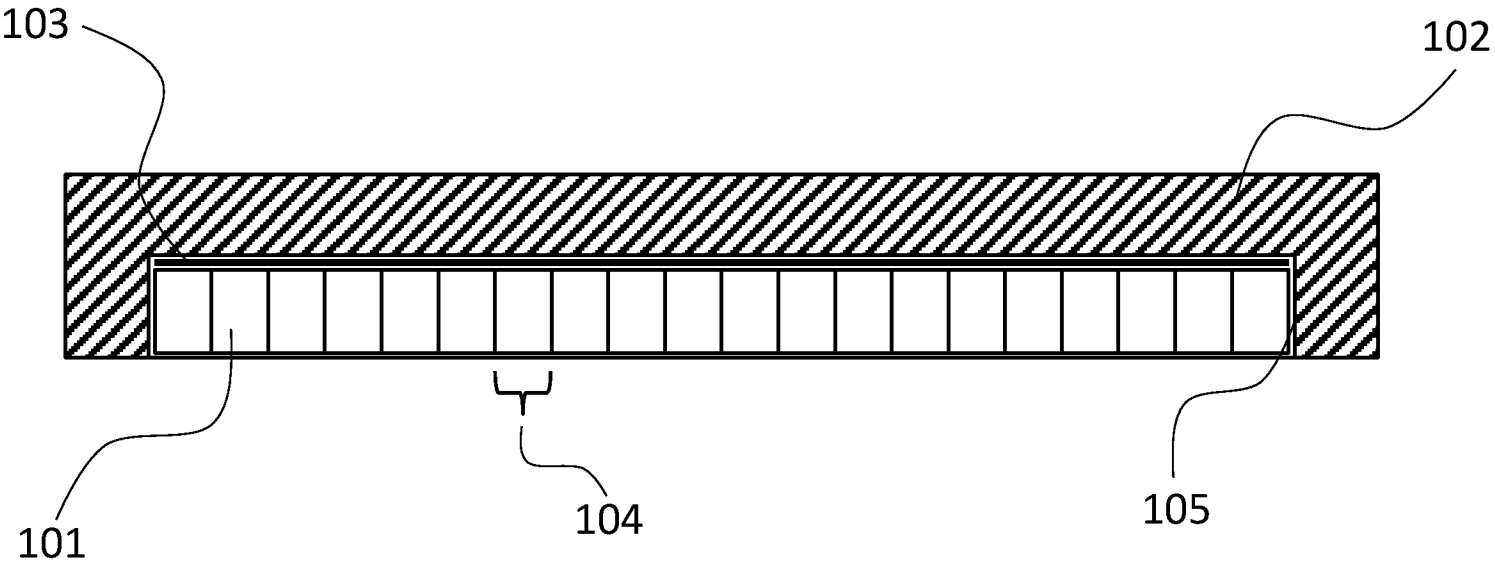
FIG. 1A illustrates a cross-sectional view of an example of a liner configuration, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense.

Various operations may be described as multiple discrete operations in turn, in a manner that may be helpful in understanding embodiments; however, the order of description should not be construed to imply that these operations are order-dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

In various embodiments, methods, apparatuses, and systems for mitigation of rotational acceleration are provided. Embodiments herein employ a novel strategy based on a floating cellular liner that acts as a torsional suspension system to dampen rotational acceleration, such as head acceleration in a helmet, in response to an oblique impact. Specifically, the torsional suspension consists of an anisotropic cellular liner that is at least partially recessed inside a rigid polymer foam shell, relative to which the cellular liner can simultaneously undergo translation and in-plane compression.

Previous attempts have employed other strategies for mitigation of rotational head acceleration to reduce the risk of brain injury that are considerably less effective. For example, intermediate layers have been used that are not permitted to slide relative to adjacent layers. Such solutions rely only on shear deformation within the layer. Other attempts use a sliding layer disposed between an inner and outer helmet shell to facilitate displacement of the outer shell relative to the inner shell. However, the intermediate layer is not capable of absorbing rotational energy by in-plane compression.

Embodiments herein provide an impact absorption system that acts as a torsional suspension system for use in protective helmets to shield the head from linear and rotational accelerations. A brain is particularly vulnerable to rotational head accelerations, but contemporary helmets lack an effective mechanism to dampen rotational head accelerations in oblique impacts. In various embodiments, the helmets disclosed herein include a torsional suspension consisting of an anisotropic cellular liner that is at least partially recessed in an adjacent shell made of rigid expanded polymer foam. The cellular liner is separated from the polymer shell by polymer film, or another barrier layer, to create a floating cellular liner that can translate relative to the adjacent polymer shell. Thus, an oblique impact to the helmet will cause relative sliding between the cellular liner and the polymer shell, simultaneously to in-plane compression of the cellular liner. In combination, this simultaneous in-plane compression and sliding will absorb torsional energy to reduce rotational head acceleration.

Embodiments herein provide protective helmets designed to lessen the amount of harmful acceleration (both straight linear and rotational) that reaches the brain of a wearer during an impact to the helmet. In various embodiments, the helmets may include the torsional suspension system for both cushioning and absorbing linear and rotational energy, thus reducing peak acceleration or deceleration of a wearer's head in an impact. In various embodiments, this reduction in head acceleration and deceleration may result in a corresponding reduction in the magnitude of acceleration or deceleration experienced by the brain, reducing the risk and/or severity of traumatic brain injury (TBI).

In various embodiments, the helmets disclosed herein may include a torsional suspension consisting of an anisotropic cellular liner that is at least partially recessed in an adjacent shell made of expanded polymer foam. In embodiments, the cellular liner is separated from the polymer shell, such as by a polymer film, to facilitate relative sliding. Thus, an oblique impact to the helmet will cause relative sliding between the cellular liner and the polymer shell, simultaneously to in-plane compression of a portion of the cellular liner. In combination, this simultaneous in-plane compression and sliding will absorb torsional energy to reduce rotational head acceleration. The cellular liner is retained within the recess of the polymer shell without the necessity of using additional fasteners, adhesive etc. Rather, the cellular liner is sized to fit snug within the recess and to be retained within the recess as a friction fit with the shell or foam. In embodiments, only a minor amount of pressure is used to reduce the size of the cellular liner, temporarily, to place it within the recess. Once the pressure is released, the cellular liner presses against the side walls of the recess and remains in place. By eliminating additional fasteners, adhesive, etc., translation of the cellular liner within the recess is not encumbered.

In various embodiments, in addition to providing a torsional suspension system, the cellular liner may also compress in a direction normal to its surface to deplete impact energy directed normal to the helmet surface.

In various embodiments, the cellular liner may also shear in part by folding or sideways collapse of its cellular structure to further mitigate torsional and normal impact loads.

In various embodiments, the cellular liner may be comprised of a lightweight aluminum structure. One of skill in the art will appreciate that other lightweight, compressible materials may be employed, such as cardboard or paper pulp, various synthetic or natural foams, plastic, polymers, and the like.

In various embodiments, the cellular liner may be comprised of a cell geometry with auxetic properties to allow for spherical deformation of the cellular liner without distorting the regular cell geometry. By using a cellular liner with auxetic properties, the cellular liner may be shaped to fit into curved recesses, as would be typical of many helmets and other articles.

In various embodiments, the torsional suspension system of the helmets disclosed herein may be used to construct any type of protective headgear, such as safety helmets, motorcycle helmets, bicycle helmets, ski helmets, lacrosse helmets, hockey helmets, football helmets, batting helmets for baseball and softball, headgear for rock and mountain climbers, headgear for boxers, construction helmets, helmets for defense and military applications, and headgear for underground activities. While helmets are described with respect to particular embodiments herein, various features herein are applicable to other articles, such as other types of protective gear, such as face masks, elbow pads, knee pads, shoulder pads, shin guards, and the like, potential impact surfaces such as various surfaces (internal or external) of a vehicle, including a dashboard and crushable surfaces on automotive brake pedals. Alternatively, embodiments described herein may also be used in association with soles of safety shoes that would dampen the impact in case of a fall from height.

FIG. 1A illustrates a cross-sectional view of an example of the impact damping system shown in a simplified manner (flat) without the spherical curvature of helmets or shapes of other articles to illustrate certain basic concepts.

The impact damping system 100 is comprised of an anisotropic cellular liner 101 that is partially recessed inside an adjacent liner 102 made of rigid polymer foam. A barrier layer 103 is located at the interface between cellular liner 101 and rigid foam liner 102 to facilitate gliding of the cellular liner 101 parallel to rigid foam liner 102. This layer 103 also prevents cells 104 of cellular liner 101 from penetrating into the surface of foam liner 102, which would restrict relative sliding between cellular liner 101 and the foam liner 102. Recess 105 provides a geometric constraint of at least a part of the periphery of the cellular liner, with recess 105 having both a base surface and side walls defining the recess or pocket in which the cellular liner fits and is constrained.

In embodiments, layer 103 may be constrained within the pocket by interaction with recess 105 or by affixation, such as adhesive, or it may be a coating, or, in other embodiments, layer 103 may essentially be free to move, but be constrained within recess 105 by the presence of cellular liner 101 in recess 105.

Figure 1B:
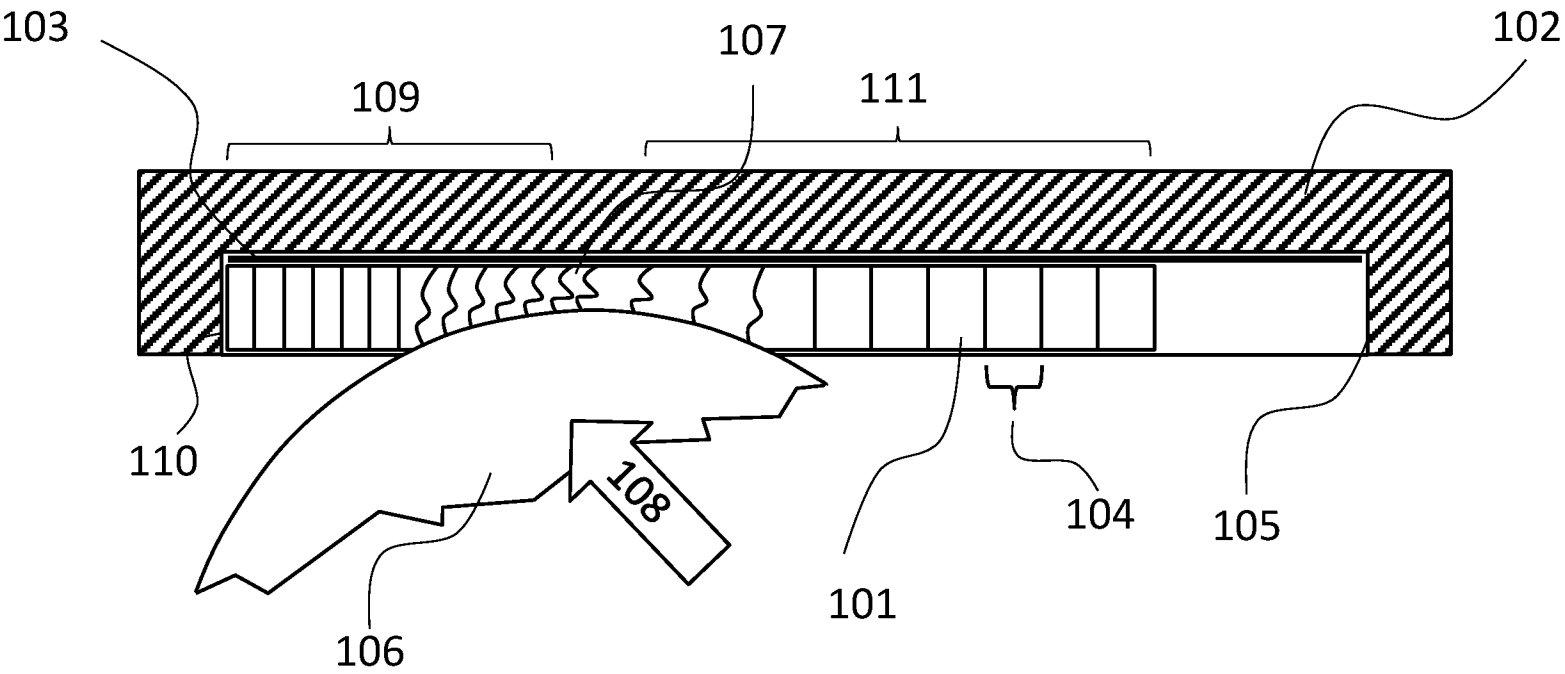
FIG. 1B illustrates the cross-sectional view of FIG. 1A, but during impact with a spherical object that subjects the cellular liner to in-plane and out-of-plane compression, in accordance with various embodiments.

FIG. 1B illustrates the same cross-sectional view of FIG. 1A, but during impact with a spherical object 106 in an oblique direction 108 that subjects the cellular liner 101 to in-plane compression, out-of-plane compression, and shear. In-plane compression of cellular liner 101 is evident by cell densification in section 109 between the impact location and the geometric constraint 110. This densification is caused by the recess in the rigid foam liner 102, which prevents translation of the boundary of cellular liner 101. In contrast, section 111 of cellular liner 101 does not exhibit in-plane compression, since it translates relative to the rigid foam liner 102, in a direction away from geometric constraint 105. Therefore, the gliding interface provided by layer 103, in combination with the geometric constraints 105 and 110 of the recessed cellular liner enables partial in-plane compression of only a section 109 of the cellular liner 101 in response to an oblique impact 108.

Out-of-plane compression and shear deformation of cellular liner 101 primarily occurs at the impact site between sections 109 and 111, and contributes to impact energy dissipation by crumpling and shear folding of cells 107 similar to a traditional crumple zone. In summary, this impact damping system delivers a unique combination of impact damping strategies to absorb normal and tangential impact forces during an oblique impact. It dampens the impact load component that acts parallel to cellular liner 101 by in-plane compression of a section 109 of cellular liner 101. It dampens the impact load component that acts perpendicular to cellular liner 101 by out-of-plane compression of cellular liner 101 at the vicinity of the impact location 107. It furthermore supports shear deformation of cellular liner 101 in the vicinity of impact location 107.

Cellular liner 101 has anisotropic properties with a compressive stiffness that is lower in-plane than out-of-plane. Consequently, the in-plane compression caused by considerable gliding and densification of cellular liner 101 is considerably greater than the out-of-plane compression of cellular liner 101 at impact location 107.

In embodiments, a barrier layer may be a film, sheet, or coating, such as polymer film.

Figure 2A:
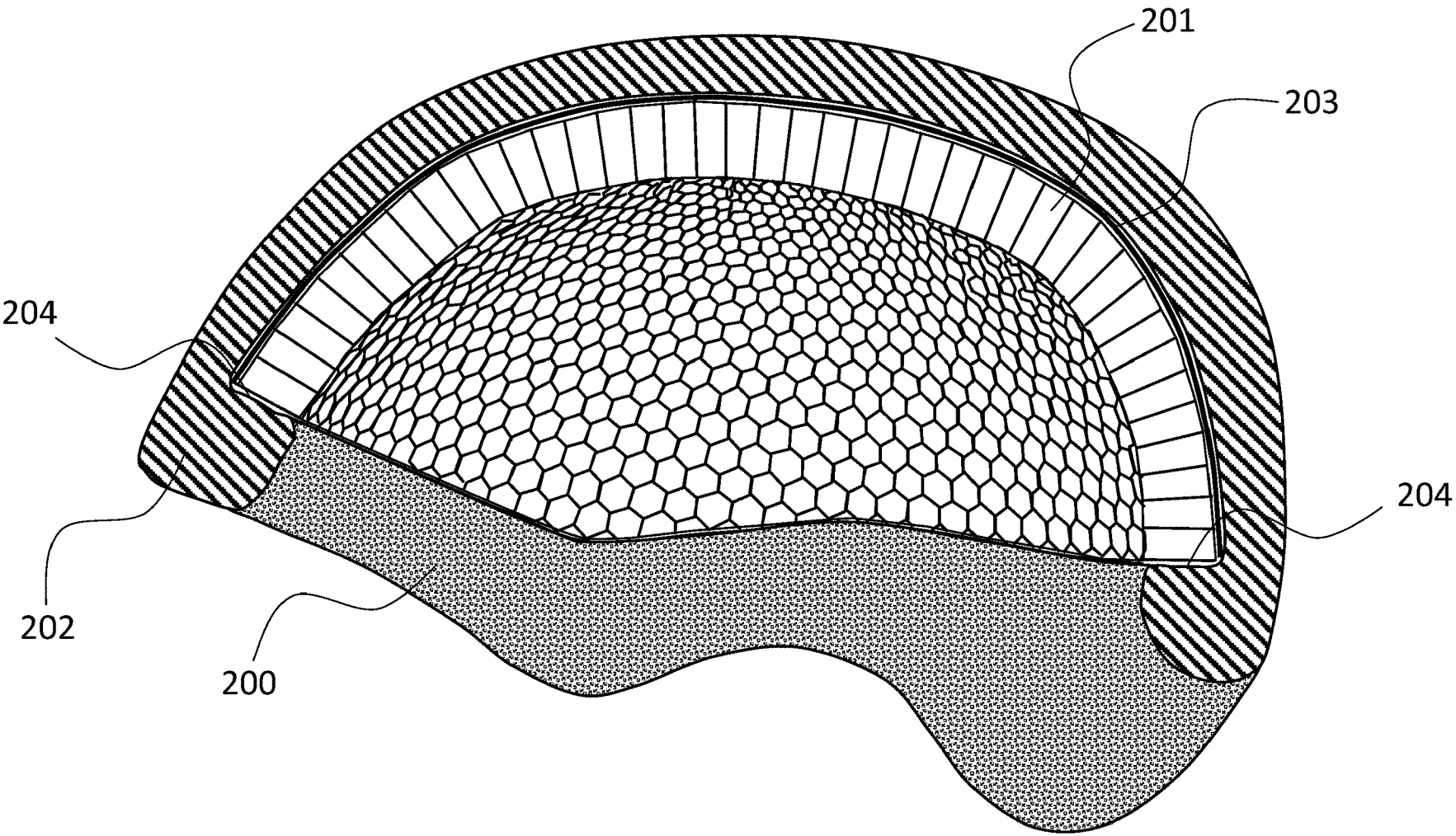
FIG. 2A illustrates a cross-sectional view of an example of a helmet, shown in unloaded, non-deformed configuration, in accordance with various embodiments.

FIG. 2A illustrates a cross-sectional view of a helmet with an example of the impact damping system. In the illustrated embodiment, the impact damping system 200 is comprised of an anisotropic cellular liner 201 that is partially recessed inside an adjacent liner 202 made of rigid polymer foam. A barrier layer 203 is located at the interface between cellular liner 201 and rigid foam liner 202 to facilitate gliding of the cellular liner 201 parallel to rigid foam liner 202. Recess 204 provides a geometric constraint along at least a part of the periphery of cellular liner 201. In various embodiments, cellular liner 201 may have a hexagonal cell geometry, or an auxetic cell geometry which allows for spherical deformation of the cellular liner while retaining a regular cell geometry.

In various embodiments, outer helmet layer 106 may be sufficiently stable, rigid, and/or non-compressible to distribute impact forces over an extended area. One of skill in the art will appreciate that the shapes depicted in the figures are merely exemplary, and that the helmet shape can vary depending on the particular sporting event or activity for which the helmet is designed. Furthermore, helmets in accordance with the present disclosure may include additional features, such as a cage for a hockey helmet, a face mask for a football helmet, a visor for a motorcycle helmet, and/or retention straps, chin straps, and the like. Although not shown in the illustrated embodiment, cellular liner 201, foam liner 202, and plastic film may include one or more ventilation openings to permit air flow for cooling the wearer's head. Although not shown in the illustrated embodiment, the cell walls of cellular liner 201 may have geometric perturbations that facilitate shear deformation and in-plane compression of cellular liner 201.

Figure 2B:
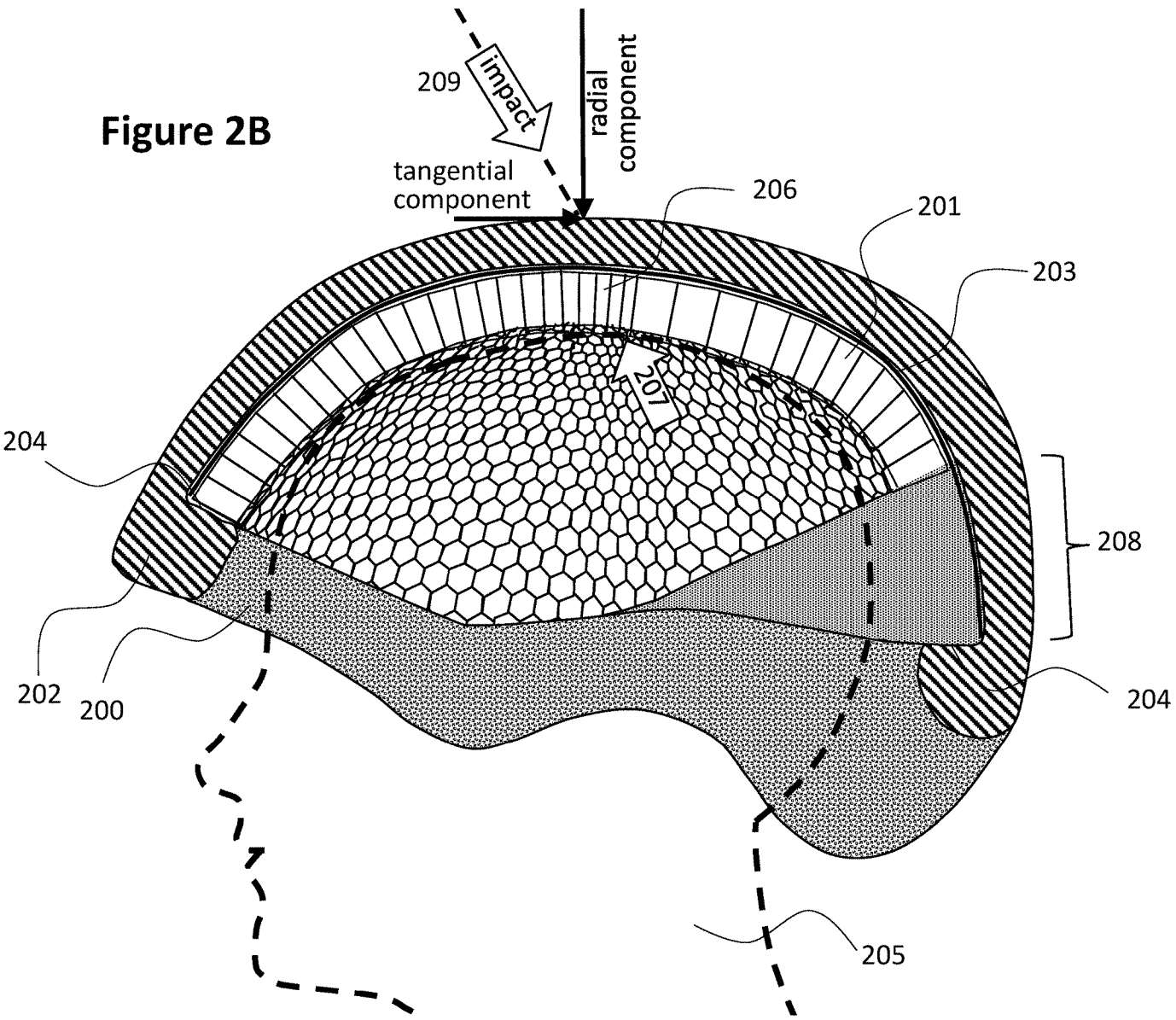
FIG. 2B illustrates the cross-sectional view of FIG. 2A, shown during impact in a loaded, partially deformed configuration, and depicting relative translation of a portion of the cellular liner, and depicting in-plane compression of another portion of the cellular liner, in accordance with various embodiments.

FIG. 2B illustrates the same cross-sectional view of FIG. 2A, but during an external oblique impact 209. This impact compresses the helmet onto the wearer's head 205 and subjects the cellular liner 201 to oblique loading 207 that is absorbed by in-plane compression, out-of-plane compression, and localized shear of cellular liner 201. In-plane compression of cellular liner 201 occurs to the left side of the impact location, as depicted by cell densification of cellular liner 201 that is pushed against geometric constraint 204. The opposite side of cellular liner 201 translates relative to the rigid polymer foam liner 202, creating an area 208 in the recessed foam liner 202 that is void of the cellular liner 201. In summary, the tangential component of impact 209 is absorbed by in-plane compression of cellular liner 202, whereby in-plane compression is distributed over a large area of cellular liner 202, extending considerably beyond the zone of impact. In contrast, the radial component of the impact 209 is absorbed by out-of-plane compression and shear in the vicinity of the impact location, albeit the resulting deformation of the cellular liner is not shown in the illustrated embodiment.

Figure 3:
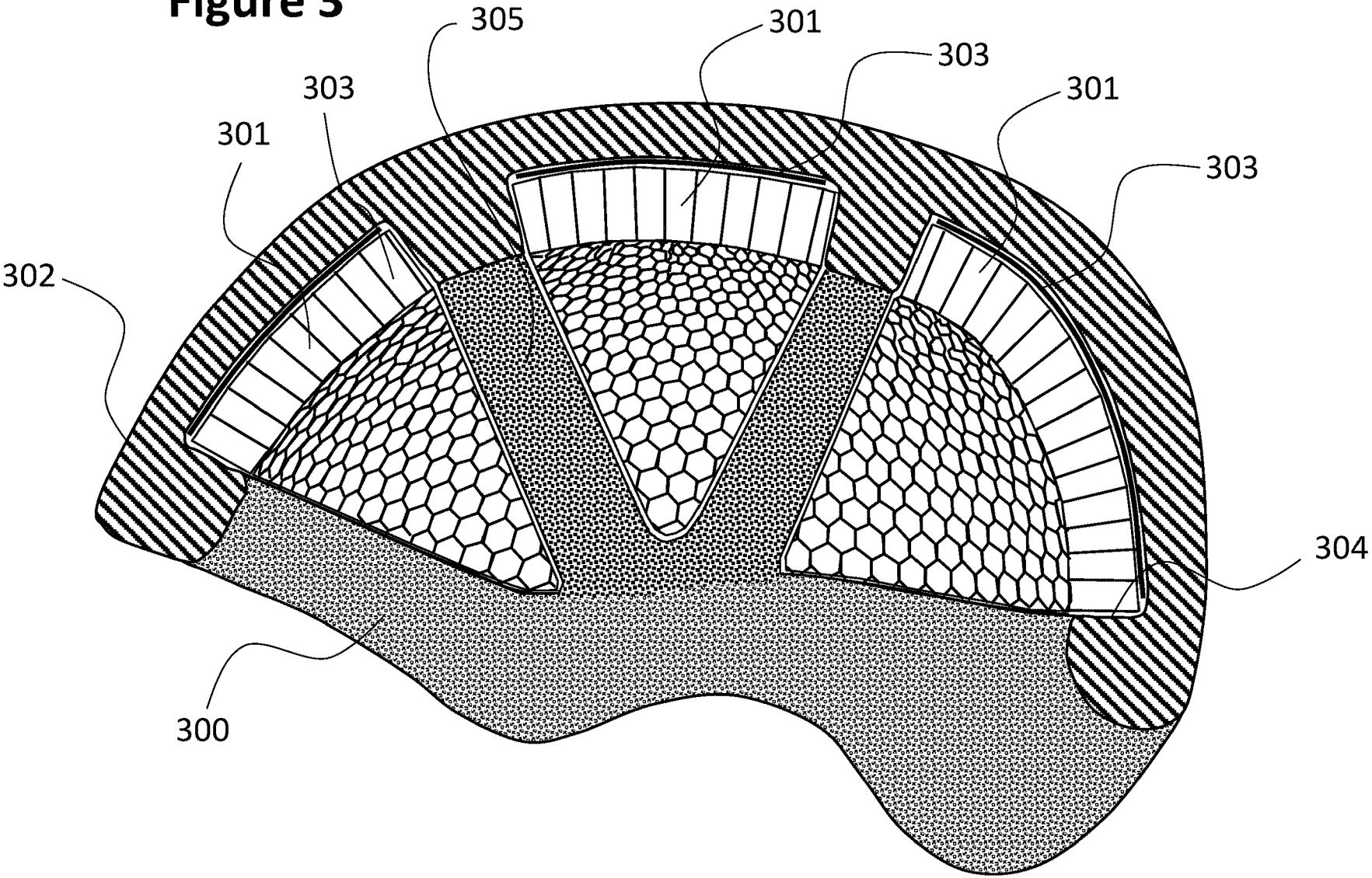
FIG. 3 illustrates a cross-sectional view of an alternative example of a helmet, wherein the cellular liner comprises two or more cellular liner segments that are recessed inside the polymer foam liner.

FIG. 3 illustrates an alternative embodiment, whereby two or more cellular liners 301 are placed in corresponding recess areas in the rigid polymer foam liner 302. Each individual cellular liner 301 is separated from foam liner 302 by a barrier layer 303 located at the interface between cellular liners 301 and rigid foam liner 302 to facilitate gliding of the cellular liners 301 relative to rigid foam liner 302.

While FIG. 3 illustrates multiple, separate cellular liners placed into separate recesses, FIGS. 2A and 2B, for example, illustrate a single/unitary cellular liner. As shown in FIGS. 2A and 2B, the unitary cellular liner extends across a substantial portion of the underlying surface area, such as at least 50%, at least 60%, or at least 70% of the surface. The underlying surface area can be defined as the inward facing surface of the foam liner, wherein the foam liner has an inward facing surface (facing toward the wearer) and an outward facing surface (facing away from the wearer). Alternatively, the underlying surface area can be defined as the outward facing surface of the foam liner. In such an embodiment, the cellular liner may be present between the foam liner and an outer hard shell.

Figure 4:
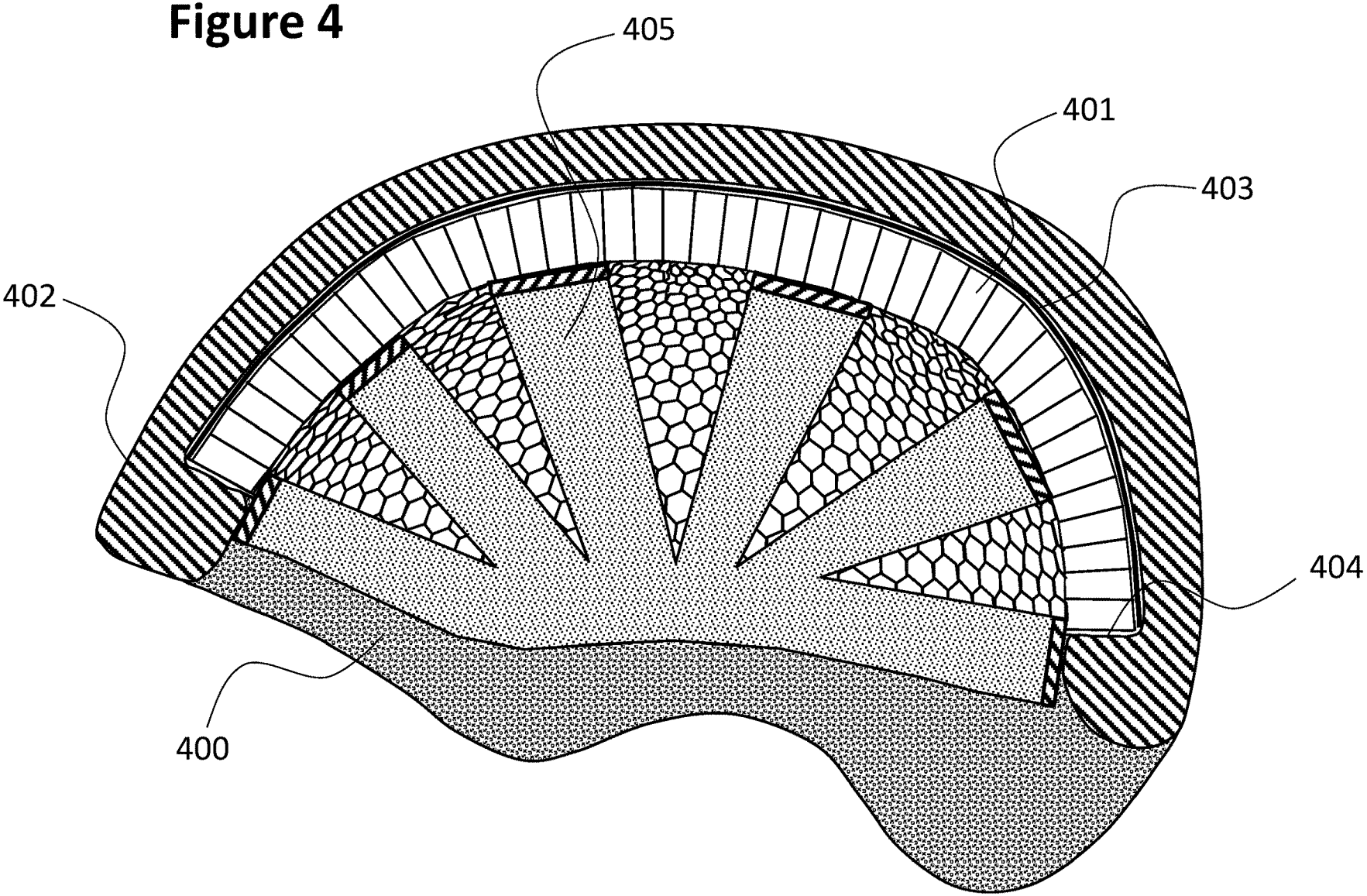
FIG. 4 illustrates a cross-sectional view of a helmet in conjunction with an inner liner used for comfort and fit to the user's head.

FIG. 4 illustrates the same cross-sectional view of FIG. 2A, but with the addition of a inner liner 405 made of a softer foam or textile material to provide improved fit and comfort for the helmet wearer. Inner liner 505 may also serve to prevent skin abrasion that otherwise could be caused during impact by direct compression of cellular liner 401 onto the wearer's head.

Figure 5:
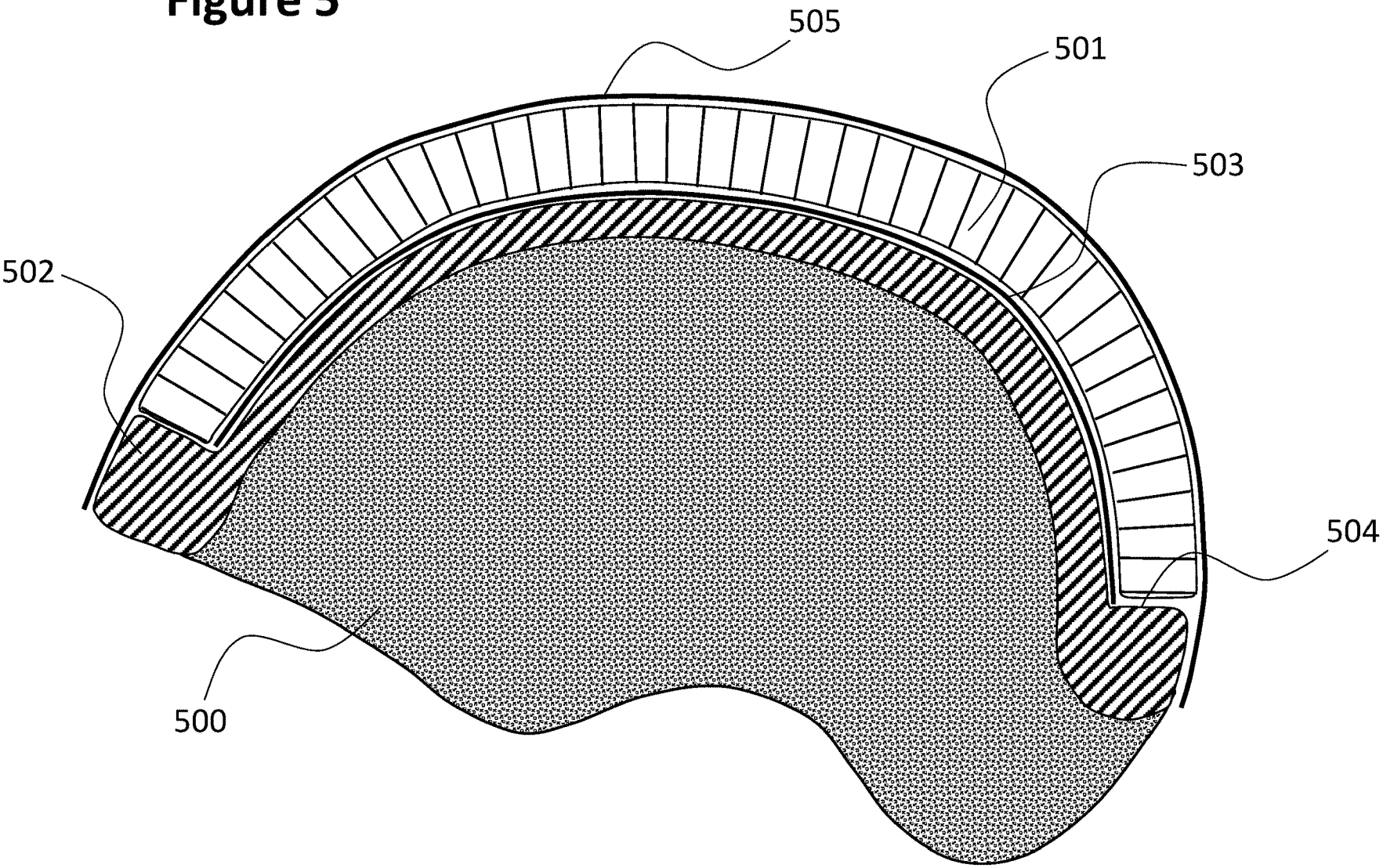
FIG. 5 illustrates a cross-sectional view of an alternative example of a helmet, wherein the cellular liner is recessed in the outside surface of the polymer foam liner and covered by an outside shell.

FIG. 5 illustrates an alternative embodiment, whereby cellular liner 501 is recessed in the outside of rigid polymer foam liner 502. A barrier layer 503 is located at the interface between cellular liner 501 and rigid foam liner 502 to facilitate gliding of the cellular liner 501 parallel to rigid foam liner 502. Recess 504 provides a geometric constraint along at least a part of the periphery of the cellular liner 501. An out shell 505 may be used to cover cellular liner 501 for added impact protection or for aesthetic reasons.

Figure 6:
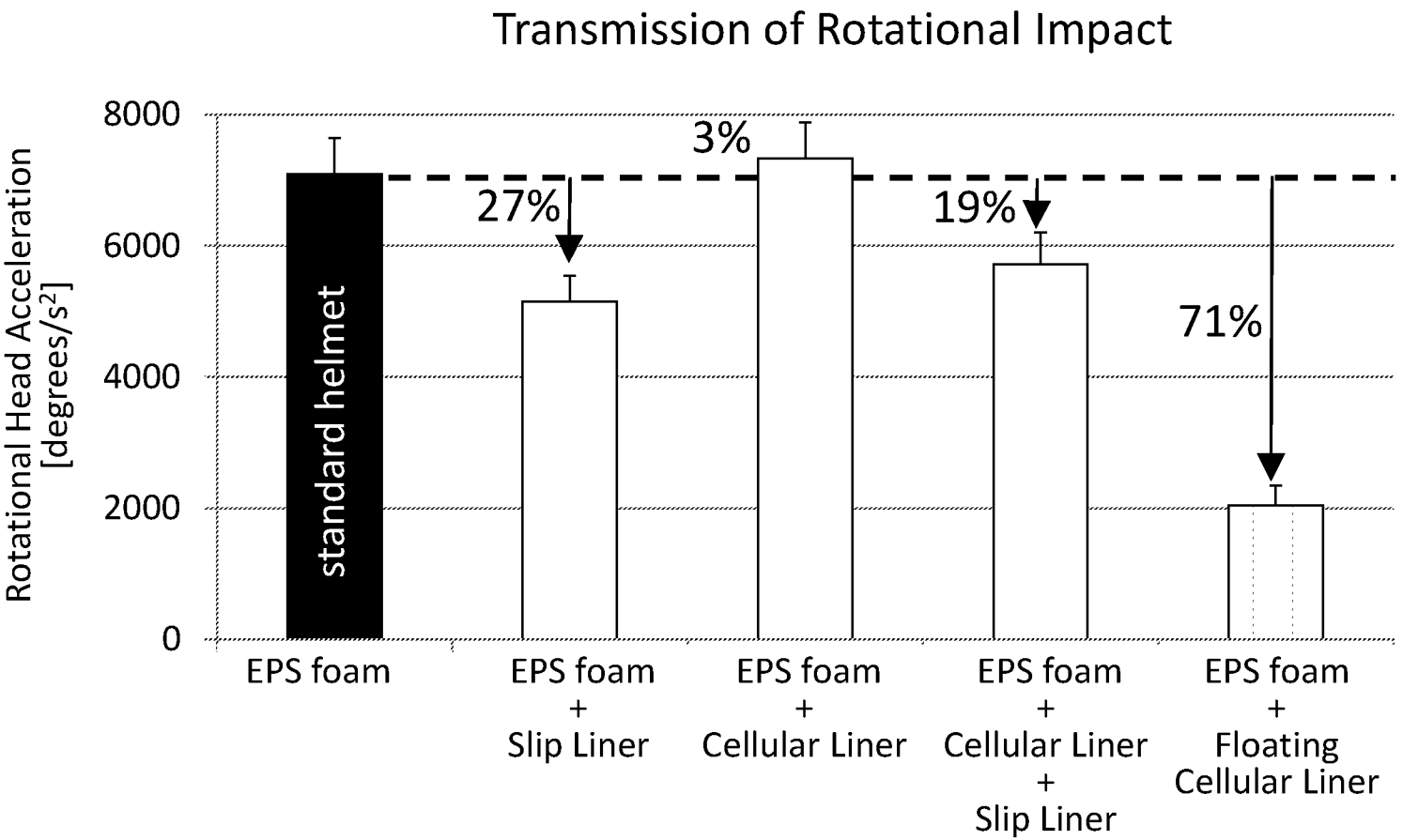
FIG. 6 depicts helmet impact test results, illustrating the efficacy by which embodiments herein mitigate rotational head acceleration compared to standard polymer foam helmets, and compared to helmets that employ alternative strategies for mitigation of rotational head acceleration.

FIG. 6 depicts helmet impact test results, illustrating the efficacy by which various embodiments herein mitigate rotational head acceleration compared to standard polymer foam helmets, and compared to helmets that employ alternative strategies for mitigation of rotational head acceleration. Adding a slip liner, commercialized under the trademark "MIPS", and disclosed by U.S. Pat. No. 6,758,671, reduces rotational head acceleration in response to an oblique impact by 27% compared to a standard bicycle helmet consisting of expanded polymer foam (EPS). Adding a honeycomb liner, commercialized under the trademark "Koroyd", into air vents of an EPS helmet shell will increase the rotational head acceleration in response to an oblique impact by 3% compared to a standard bicycle helmet consisting of expanded polymer foam (EPS). Combining both the "MIPS" slip liner and the "Koroyd" honeycomb-filled air vents will decrease the rotational head acceleration in response to an oblique impact by 19% compared to a standard bicycle helmet consisting of expanded polymer foam (EPS). In contrast, recessing the floating cellular liner as described herein in an EPS shell will decrease the rotational head acceleration in response to an oblique impact by 71% compared to a standard bicycle helmet consisting of expanded polymer foam (EPS). This direct comparison of technologies demonstrates that embodiments herein achieve an unprecedented level of impact absorption that cannot be achieved or replicated by merely combining existing technologies of slip layers and cellular liners.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A protective helmet, comprising:

an anisotropic cellular liner with a compressive stiffness that is lower in-plane than out-of-plane;

a rigid foam liner; and a barrier layer between the anisotropic cellular liner and the rigid foam liner, wherein the barrier layer prevents penetration of the anisotropic cellular liner into the rigid foam liner, wherein the anisotropic cellular liner is at least partially recessed in a recess formed in the rigid foam liner, wherein the anisotropic cellular liner and the recess are sized such that the anisotropic cellular liner is confined and retained in the recess of the rigid foam liner by a friction fit, and wherein the barrier layer facilitates relative sliding of the anisotropic cellular liner within the recess of the rigid foam liner and with respect to the rigid foam liner.

2. The protective helmet of claim 1, wherein the anisotropic cellular liner is comprised of an open cell structure with auxetic properties to allow for spherical deformation of the anisotropic cellular liner without irregular distortion of the anisotropic cellular liner.

3. The protective helmet of claim 1, wherein the anisotropic cellular liner has an in-plane compressive stiffness and an out-of-plane compressive stiffness, and the in-plane compressive stiffness is at least 50% lower than the out-of-plane compressive stiffness.

4. The protective helmet of claim 1, wherein the barrier layer comprises a coating, film, or discrete sheet element, and wherein the barrier layer is present only in the recess between the anisotropic cellular liner and the rigid foam liner.

5. The protective helmet of claim 1, wherein the barrier layer comprises a polymer film.

6. The protective helmet of claim 1, wherein the rigid foam liner is made of expanded foam.

7. The protective helmet of claim 1, wherein the rigid foam liner has an inward facing surface and an outward facing surface, and the recess is recessed into the inward facing surface or the outward facing surface of the rigid foam liner.

8. The protective helmet of claim 1, wherein shear-loading in response to an oblique impact to the protective helmet is at least partially absorbed by in-plane compression of a portion of the anisotropic cellular liner, caused by tangential translation of a portion of the anisotropic cellular liner within the recess of the rigid foam liner.

9. The protective helmet of claim 1, wherein the rigid foam liner has an inward facing surface and an outward facing surface, and the anisotropic cellular liner is a unitary structure that covers at least 50% of the inward facing surface or outward facing surface of the adjacent liner made of rigid foam.

* * * * *